US009731310B2

(12) United States Patent
Geldard

(10) Patent No.: US 9,731,310 B2
(45) Date of Patent: Aug. 15, 2017

(54) SPRAY HEAD WITH REFILL VALVE

(71) Applicant: Stephen Geldard, San Jose, CA (US)

(72) Inventor: Stephen Geldard, San Jose, CA (US)

( * ) Notice: Subject to any disclaimer, the term of this patent is extended or adjusted under 35 U.S.C. 154(b) by 48 days.

(21) Appl. No.: 15/055,471

(22) Filed: Feb. 26, 2016

(65) Prior Publication Data

US 2016/0256882 A1 Sep. 8, 2016

Related U.S. Application Data

(60) Provisional application No. 62/126,967, filed on Mar. 2, 2015.

(51) Int. Cl.

| | |
|---|---|
| ***B05B 11/00*** | (2006.01) |
| ***B05B 15/00*** | (2006.01) |
| ***B65B 3/04*** | (2006.01) |
| *B65B 7/00* | (2006.01) |
| *B65B 7/26* | (2006.01) |

(52) U.S. Cl.

CPC ..... *B05B 11/3047* (2013.01); *B05B 11/0016* (2013.01); *B05B 15/005* (2013.01); *B05B 11/0056* (2013.01); *B05B 11/0097* (2013.01); *B05B 11/3009* (2013.01); *B05B 11/3045* (2013.01); *B65B 3/04* (2013.01); *B65B 7/00* (2013.01); *B65B 7/26* (2013.01)

(58) Field of Classification Search

CPC ..... B05B 11/3047; B05B 11/3045; B05B 11/0016; B05B 11/0097; B05B 15/005; B05B 11/3009; B05B 11/0056; B65B 3/04; B65B 7/00; B65B 7/26

See application file for complete search history.

(56) References Cited

U.S. PATENT DOCUMENTS

| | | | | |
|---|---|---|---|---|
| 4,186,783 A * | 2/1980 | Brandt | B05B 9/0816 141/18 |
| 5,964,377 A * | 10/1999 | Demarest | B05B 11/0051 222/136 |
| 6,345,738 B1 * | 2/2002 | Brozell | B05B 11/3009 141/18 |
| 2002/0020720 A1 * | 2/2002 | Schmid | B05B 11/0037 222/383.1 |
| 2009/0095822 A1 * | 4/2009 | Chen | B05B 11/0056 239/302 |

(Continued)

FOREIGN PATENT DOCUMENTS

| | | | |
|---|---|---|---|
| JP | 11019551 A * | 1/1999 | B05B 11/0056 |
| JP | 2003012009 A * | 1/2003 | B05B 11/0097 |

*Primary Examiner* — Frederick C Nicolas

(74) *Attorney, Agent, or Firm* — Douglas L. Weller

(57) ABSTRACT

A spray head for a spray bottle includes a spray mechanism connected to a tube that extends into the spray bottle. The spray mechanism draws fluid from a bottom of the spray bottle, through the tube, to produce a spray of the fluid. A threaded female fitting attaches to a threaded top of the spray bottle. The threaded female, when screwed on to the threaded top of the spray bottle, securely attaches the spray head to the spray bottle. A refill valve, when opened, provides a conduit to refill the spray bottle so that fluid can be poured into the spray bottle without unscrewing the threaded fitting and removing the spray head from the spray bottle. A refill valve cap, when in a shut position, closes the refill valve to prevent spilling of the liquid when the spray bottle is not being refilled.

20 Claims, 8 Drawing Sheets

(56) References Cited

U.S. PATENT DOCUMENTS

2010/0096414 A1* 4/2010 Dennis ..... B05B 11/0005
222/383.1
2014/0069962 A1* 3/2014 Dennis ..... B05B 11/001
222/382
2014/0346193 A1* 11/2014 Conway ..... B05B 11/3011
222/173

* cited by examiner

SPRAY HEAD WITH REFILL VALVE

BACKGROUND

Spray bottles, spray heads and similar hand-held consumer and industrial fluid delivery devices typically transport fluid from the bottom of a container via a dip tube to a spray nozzle head. When all the fluid has been used, the spray bottle is typically discarded. If there is an available ready-made refill solution available, the spray bottle may be opened, refilled and reused. When a refill is carried out, the spray head must be removed with the dip tube intact, the bottle filled and re-sealed ready for another use. The consumer can either pour the refill solution from the container to the bottle by hand poring through the bottle neck or by using a standard funnel.

DESCRIPTION OF THE EMBODIMENTS

Figure 1:
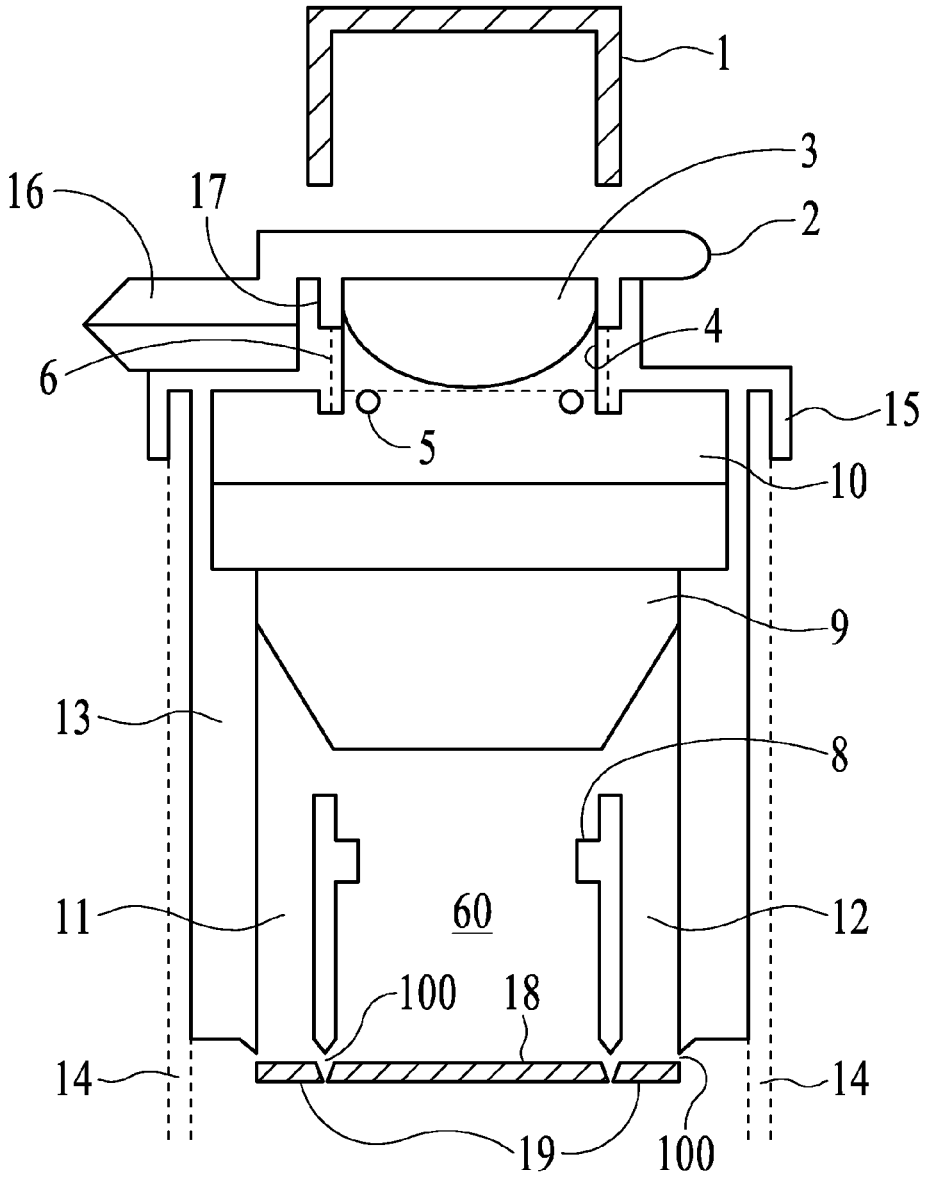
FIG. 1 shows a cross section of a cartridge refill valve body in accordance with an implementation.

A spray head and bottle assembly can only be refilled by unscrewing the spray head, removing the head and dip tube in one piece, placing a funnel in the bottle opening and pouring the ready made refill solution inside. This would only be applied if the manufacturer's product has a refill solution available for purchase. The time and cleanup it takes for the refill is an important factor and unscrewing the spray head deters people from using standard refill options. A cartridge refill valve, or refill port opening in the top of the spray head using a quick delivery applicator, such as a syringe, containing a concentrate solution or powder can deliver the concentrate solution via the cartridge refill valve or port opening from the spray head without unscrewing the spray head. A standard funnel or molded attached funnel that fits exactly to the bottom of the contours of the bottle can be used to connect to the spray head with connection port to the spray head via the refill cartridge valve or integrated refill valve. The refill valve without nonreturn seals can also be used and will allow a quick refill or charge through the valve without opening the bottle with a screw top cap or flip top cap without using a funnel. The fluid can fill directly through an open port through the spray head and valve body into the bottle via a modified seal and then the refill valve can be resealed ready for reuse without removing the dip tube or spray head.

In accordance with various embodiments disclosed herein, a spray bottle system includes a spray bottle that holds liquid. The spray bottle has a threaded top. A tube extends to a bottom of the spray bottle. A spray head is attached to the tube. The spray head includes a threaded female fitting that attaches to the threaded top of the spray bottle. The threaded female, when screwed on to the threaded top of the spray bottle, securely attaches the spray head to the spray bottle. A spray mechanism is connected to the tube. The spray mechanism draws fluid from the bottom of the spray bottle, through the tube, to produce a spray of the fluid. A refill valve, when opened, provides a conduit to refill the spray bottle so that fluid can be poured into the spray bottle without unscrewing the threaded fitting and removing the spray head from the spray bottle. A refill valve cap, when in a shut position, closes the refill valve to prevent spilling of the liquid when the spray bottle is not being refilled.

For example, the refill valve cap includes a hinge that keeps refill valve cap attached to the spray head when the refill valve is in an open position. For example, the spray head additionally includes a vent line that vents the spray bottle when the spray bottle is being filled with fluid through the refill valve. The vent line allows air to escape from the spray bottle as fluid is being added to the spray bottle through the refill valve.

For example, the spray head additionally includes a receptacle for an applicator. A cross slit valve is situated between the receptacle and the refill valve so that the applicator can be pushed into the refill valve, through the cross slit valve to be received by the receptacle.

For example, a funnel is sized so that a narrow bottom part of the funnel fits within the refill valve. For example, a wider top shape of the funnels conforms to an outside shape of a bottom of the spray bottle, allowing the funnel to be secured as a sleeve on the bottom of the spray bottle. For example, the funnel includes a compression fitting for securing the funnel to the spray bottle. For example, the funnel includes a clip for securing the funnel to the spray bottle.

Figure 2:
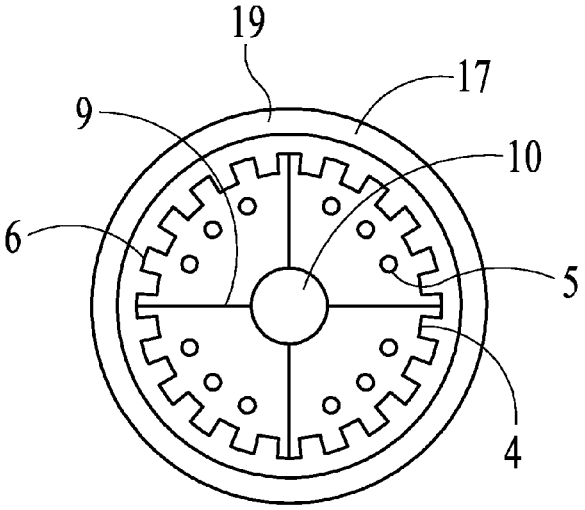
FIG. 2 shows a cross-sectional view of a valve opening in accordance with an implementation.
Figure 3:
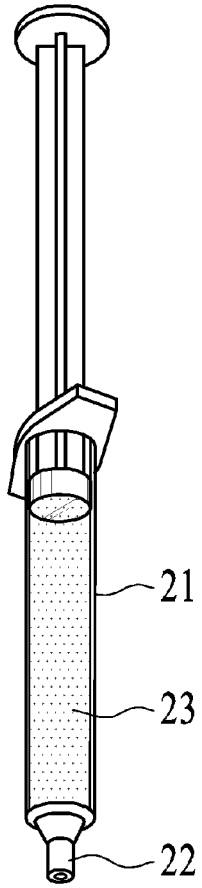
FIG. 3 shows an applicator syringe in accordance with an implementation.

FIG. 1 shows a side view or cross section of a cartridge refill valve body which contains a set of two valves, a dispensing valve and a cross slit valve. FIG. 2 shows a top view of the valve opening can also be seen looking down inside the valve with vents molded in the plastic flip top side wall with the flip top cap in the open position. Also showing are the vent holes in the dispensing valve and openings for the cross slit valve. FIG. 3 shows an applicator syringe which contains a chemical concentrate solution or powder and a screw cap that would be used in place of the flip top cap.

Specifically, and for example, FIG. 1 shows a cross section of cartridge refill valve with a flip top cap 2 or standard screw cap 1. To refill the empty bottle using the refill valve, flip top cap 2 is opened and hinge 16 is opened. Seal 17 is broken by opening flip top cap 2. The ball seal 3, when flip top cap 2 is in the closed position, compresses against the opening in sealed dispensing valve 10 and vent holes 5. When flip top cap 2 is in the open position, this exposes the dispensing valve 10. When flip top cap 2 is in the open position, side walls of the opening 4 are exposed. Integrated within side wall 4 are vent lines 6 which are molded into side wall 4. Vent lines 6 act as an air vent escape route for displaced air escaping from bottle 45 as the refill takes place. Vents 6 also act as a safety device so that the bottle cannot be over pressurized when using a faucet or a standard funnel. The body of the refill vale 13 is also shown in FIG. 1.

As shown in FIG. 3, an applicator 21 is filled with a concentrate solution 23 is now ready for dispensation. For example, applicator 21 is a syringe or other application capable of dispensing liquid through dispensing valve opening 10. Cap 22 is removed from the applicator 21 and the applicator 21 is placed directly through the dispensing valve opening 10. The applicator 21 is pushed through the cross slit valve 9 continuing until it docks in receptacle 8. The dock provides lateral and vertical stability for applicator 21. The concentrate solution 23 is then injected through the valve system via fill line 60. The concentrate 23 flows when injected into spray head cavity 59 (shown in FIG. 8) and via fill line 60, through the holes in the modified seal 51 and openings 29 and 31.

When applicator 21 is removed, a standard funnel can be mated to opening side wall 4 and water from a faucet can be used to fill via fill line 60. With the funnel now connected, the filling process can be performed using a standard kitchen faucet, bathroom sink faucet, bath faucet or garden faucet can now be used. Water is added through the funnel or directly and through fill line 60 into cavity 59 (shown in FIG. 8), through seal 29 and 31 and inside the bottle 45. The bottle can also be filled with water from a faucet directly via fill line 60 if no internal dispensing valve 10 is used or cross slit valve 9 is used. The refill of water would simply flow via line 60, through the spray head 65 to the bottle 45 via modified seal 51 using a Venturi design to increase flow and filling speed. The Venturi design creates a pressure drop within the refill valve and the modified seal 51 to the bottle 45 which in turn increases the flow rate for a fast refill. Flip top cap 2 or screw cap 1 is replaced and sealed when the refill is complete.

For the refill process to work efficiently and quickly, there must be an air venting mechanism that can vent low pressure air from escaping bottle 45 as the refill concentrate and water are added via the refill valve. The water will displace the air inside the bottle 45 and will escape through a path created inside the device using vent lines 11 and 12.

FIG. 1 also shows two connection ports 18 and 19 that allow the cartridge refill valve to be connected if necessary. The cartridge valve is designed to be manufactured as a complete unit with spray head or a stand-alone cartridge valve that can be added to the spray head or bottle after market. If a stand-alone cartridge valve is added to the spray head or bottle after market, a set of "blank" ports made of soft thin penetrable plastic 19 and 18 act as seals and are installed in the manufacturing process of the spray head in cavity 59. These can be broken by the implementation or addition of the cartridge valve. The blanks 18 and 19 can be broken as the valve is inserted. The fill valve vent lines 11 and 12 and fill line 60 will have spear pointed tips 100 that can stab or cut the blanks 18 and 19 in turn creating a seal, connecting a circuit. FIG. 1 shows plastic guides 14 which serve as a guide to position the cartridge valve until a connection is made. The cartridge is placed in the guided 14 opening and pushed by hand until it snaps in place using connection 15.

When using funnel 48 to complete the refill process, funnel 48 is removed from the bottom of bottle 45. The nozzle 49 is extended through the refill valve past dispensing valve 10, through cross slit valve 9 until it docks in receptacle 8. Receptacle 8 provides lateral and vertical stability for nozzle 49 and funnel 48 while water or fluid is being filled via fill line 60. When the refill has taken place funnel 48 is removed. Cap 1 or flip top cap 2 is replaced creating an airtight seal. The bottle is now ready for use.

The purpose of the cross slit valve 9 and the dispensing valve 10 are for safety precautions and preventative measures directed towards children tampering with the bottle. If cap 1 or flip top cap 2 is open, the cross slit valve and dispensing valve will automatically close If the spray head or bottle is inverted when filled with chemical solution. The water pressure via the refill valve creates a back pressure against the cross slit valve 9 and the dispensing valve 10. Both will automatically close when they see a back pressure. Both valves 10 and 9 are zero opening pressure valves which allow the flow of air and fluid in one direction but will close when the fluid or air pressure inside the bottle closes the valves. The valves 9 and 10 also prevent leakage as the spray bottle is used at any angle and upside down.

Figure 4:
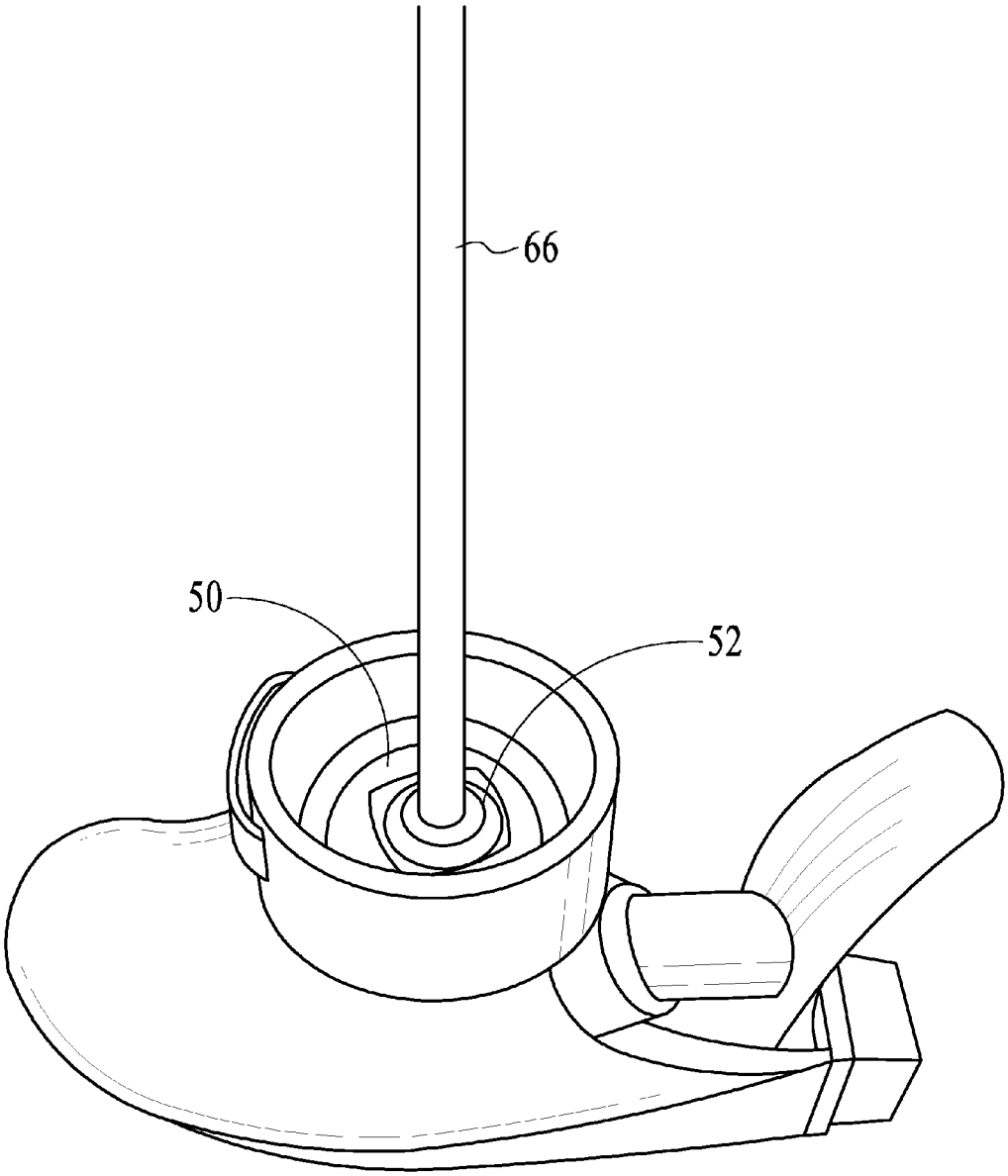
FIG. 4 shows an industry standard existing seal integrated into a spray head in accordance with an implementation.

FIG. 4 shows an industry standard existing seal integrated into a spray head. The seal creates a seal between the bottle neck and the spray head. FIG. 4 shows a single dip tube extending from the spray head. The seal is held in place by a plastic retaining ring. Specifically, FIG. 4 shows a standard spray head with inserted dip tube 66, seal 50 and retaining ring 52, which holds the seal in place. Seal 50 compresses against cavity 59 (shown in FIG. 8) and against flange face 28 to provide an air and water tight seal from the spray head to the bottle 45

Figure 5:
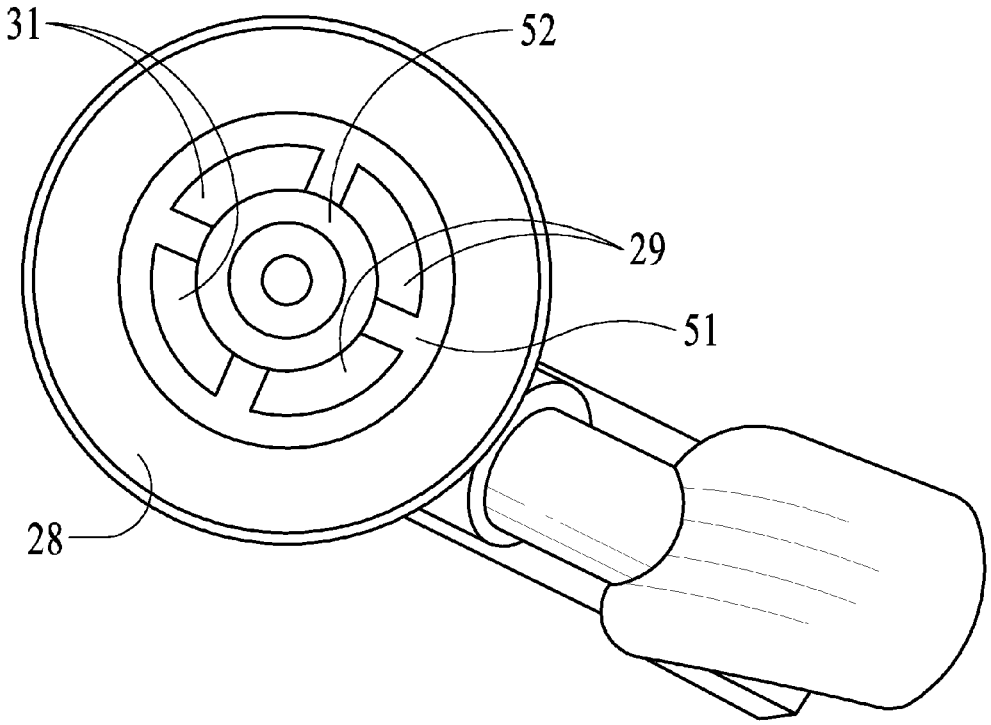
FIG. 5 shows a modified seal with cutouts with an existing retaining ring in accordance with an implementation.

FIG. 5 shows a modified seal with cutouts with an existing retaining ring. The modified seal creates a seal against the bottle neck from the spray head when the spray head is attached and tightened. Specifically, FIG. 5 shows a modified spray head seal 51 that connects to cavity 59 sealing against flange face 28. Seal 51 compresses against cavity 59 and against flange face 28 to provide an air and water tight seal from the spray head to the bottle 45 retaining ring 52 enables the seal to clip to the plastic which is connected to the dip tub opening receptacle. The modified seal 51 in FIG. 5 has four sections cut out 29 and 31 which allow the fill fluid and concentrate solution 23 and water to pass into the bottle 45 from the refill valve via fill line 60. Modified seal 51 compresses against cavity 59 and against flange face 28 to provide an air and water tight seal from the spray head to the bottle 45

Figure 6:
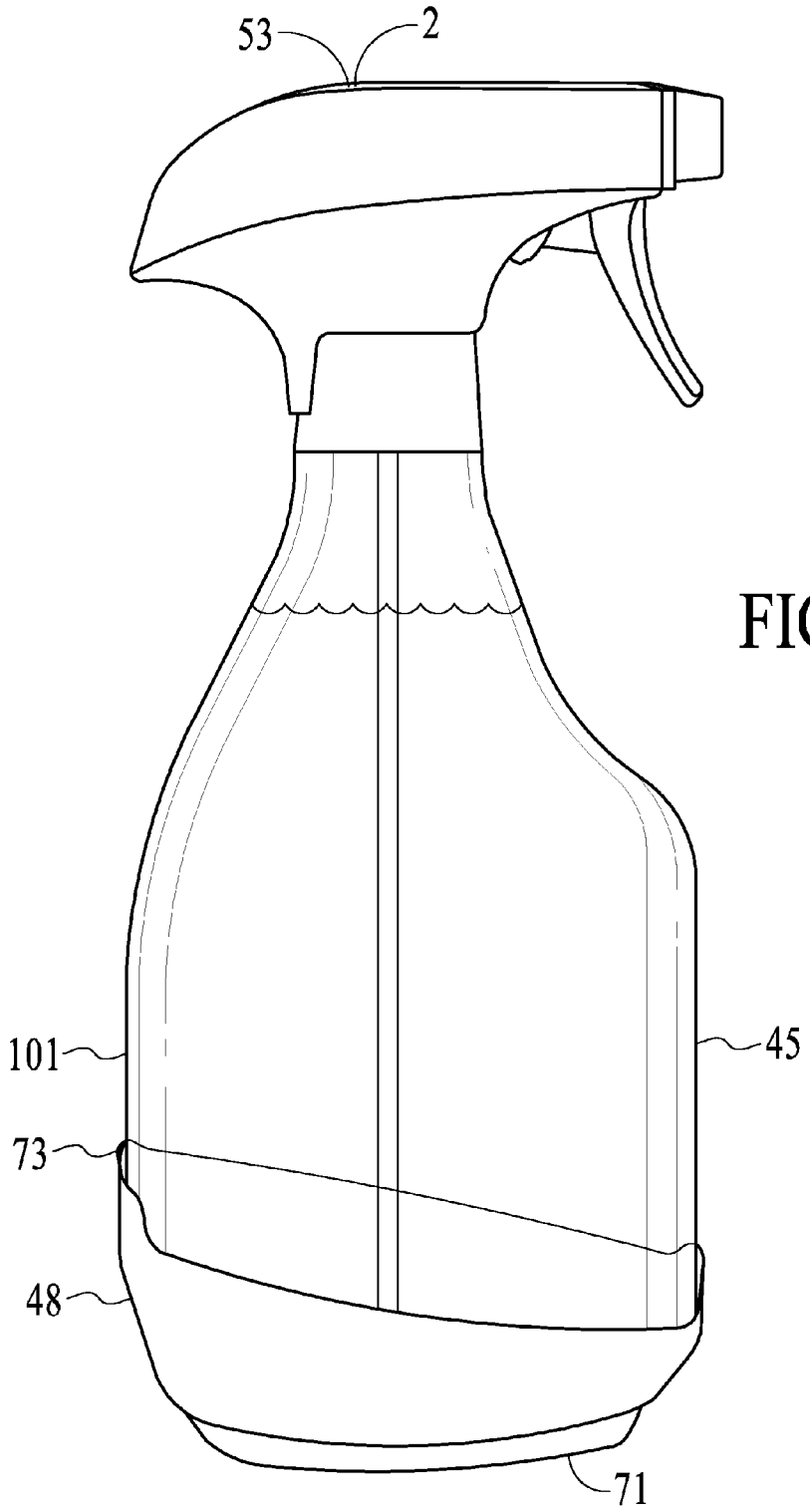
FIG. 6 shows a spray bottle and spray head with a molded removable hard funnel that fits and molds exactly around the bottle in accordance with an implementation.

FIG. 6 shows a standard industry spray bottle and spray head. The position for a refill cartridge or integrated non-cartridge valve is indicated. A molded removable hard funnel that fits and molds exactly around the bottle is also shown attached to the bottom of the bottle. Each bottle is scanned in three dimensions to exactly match the contours of any spray bottle or standard non spray bottle. Specifically, FIG. 6 shows a spray bottle 45 sitting inside a molded hard plastic funnel 48 with a telescoping nozzle 49. The funnel is molded and conforms to the shape of the bottle. The hard funnel 48 stays with the bottle at all times until needed for a refill. The funnel 48 is simply slipped or removed from the bottle 45 held in place with a compression fitting or uses a clip 70 (shown in FIG. 9) which is a male connection and clips to a female receptacle 101 that is molded into bottle 45. Nozzle 49 is connected to the fill valve opening by removing the flip top cap 2. The fill process is the same as described above when using a standard funnel or molded funnel 48. FIG. 6 shows the entrance or connection location 53 for the refill valve depicted in FIG. 1 and also shows flip top cap 2.

Figure 7:
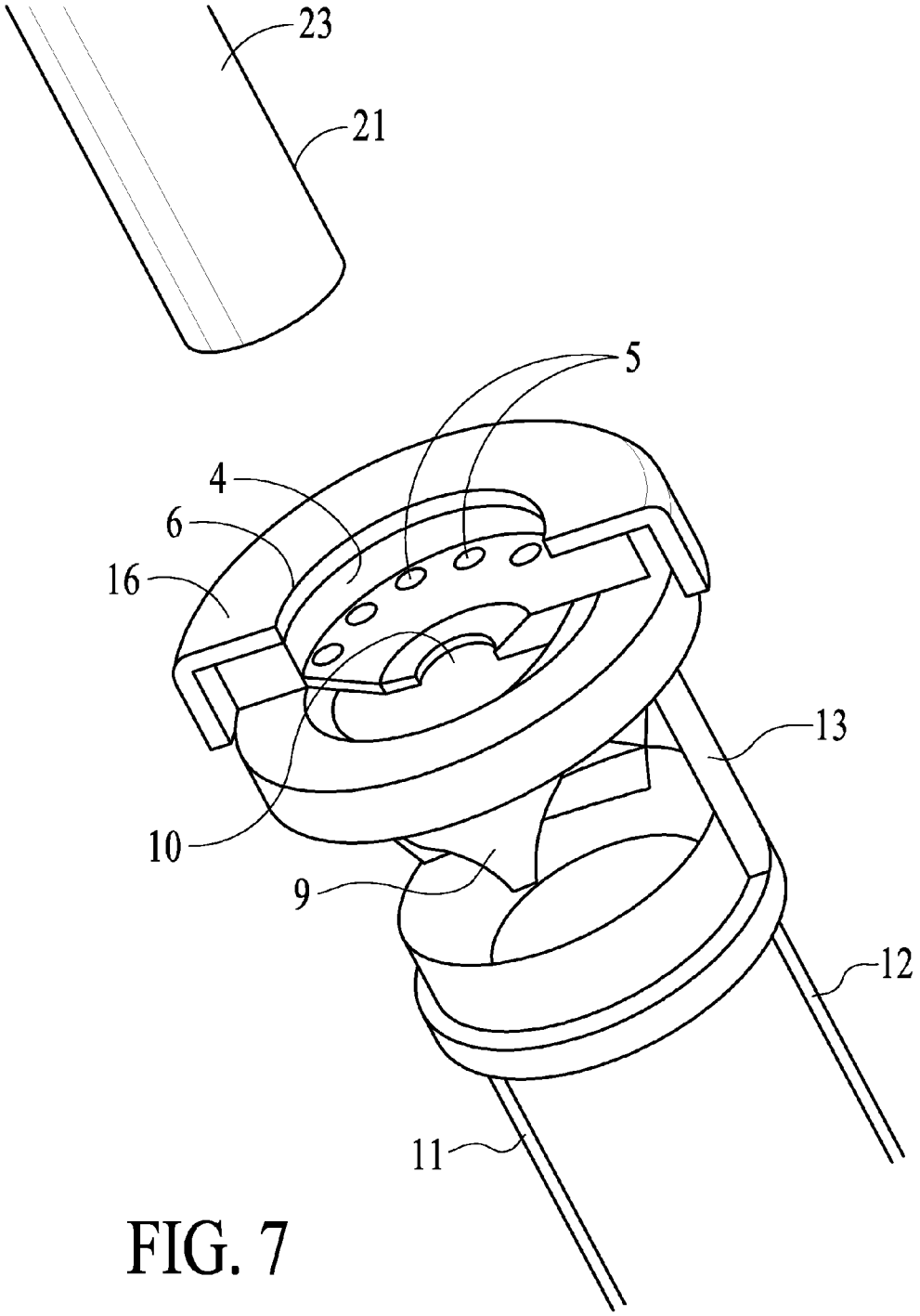
FIG. 7 shows an internal configuration inside a refill valve body assembly in accordance with an implementation.

FIG. 7 shows the internal configuration inside the refill valve body assembly with air vent lines, concentrate syringe applicator, delivery port opening for the refill valve and non-return seals inside the valve. Specifically, FIG. 7 shows the valve body 13 with integrated air vent line 11 and air vent line 12. As the air is displaced during the filling process, air will rise to its highest point inside cavity 59. Air vent 11 and 12 are connected to cavity 59. Air travels through both lines 11 and 12 where it can escape through the cross slit valve 9 openings that are made by the funnel nozzle 49 when the cross slit valve 9 is in the open position. The venting or escaping air continues to travel through the dispensing valve 10 and exit via vents holes 5. The air is also allowed to escape via vents 6. Vents 6 are molded into the sidewall 4 of the cartridge or built in valve system so that if a standard funnel is used or molded funnel 48 is used a seal can not be established that would stop the flow of air escaping from bottle 45 which would in turn create a hydraulic lock and no fluid flow would take place. Both airline 11 and 12 and fill line 60 are separated so the path of air returning up through the valve around funnel nozzle 49 doesn't interfere with the incoming fluid flow path but air can still travel through the openings of cross slit vale 10 with the nozzle 49 in place. Both water and air can pass through a single valve in opposite directions.

Escaping air travels through the cross slit valve 9 continuing up through the vent holes 5 into vent holes 6, which are molded into the flip top 2 opening side wall 4. The molded funnel 48 with nozzle 49 or any standard funnel, will not be able to provide a seal to the side wall opening 4, allowing a constant air vent path via vent 6 to the surrounding ambient air. This safety feature allows for a rapid refill without the possibility of a seal created between the standard funnel which would create a hydraulic lock, stopping the refill process. The venting system 5 and 6 prevent forced filling by a constant pressure as provided by standard water pressure as a faucet runs or continues to overflow.

Figure 8:
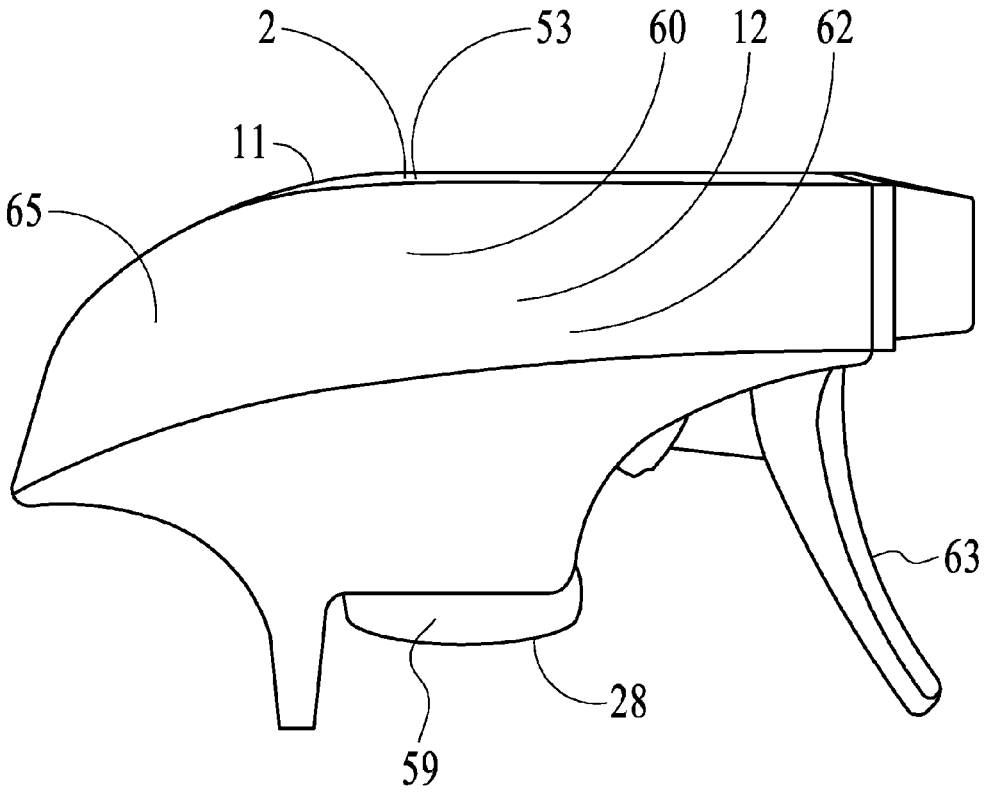
FIG. 8 shows a spray head with connection port for the refill cartridge or integrated refill valve to the spray head in accordance with an implementation.

FIG. 8 shows a standard spray head with connection port for the refill cartridge or integrated refill valve to the spray head. This port or cavity can accept the refill valve with internal non-return seals or without the non-return seals. The drawing also shows the cavity section with vent lines for refill usage. Specifically, FIG. 8 shows a cutaway view of a standard spray head 62 with trigger 63. The spray head housing 65 is penetrated by removing a plastic blank so that the refill valve cartridge can be inserted and connect to cavity 59. The position of the refill valve is shown by position 53, air vent lines 11 and 12 and fill line 60 that connects to cavity 59. The position of flip top cap 2 is also indicated. The flange face 28 compresses against the modified seal 51. This refill valve can also be molded into a spray head without having to use a cartridge system.

Figure 9:
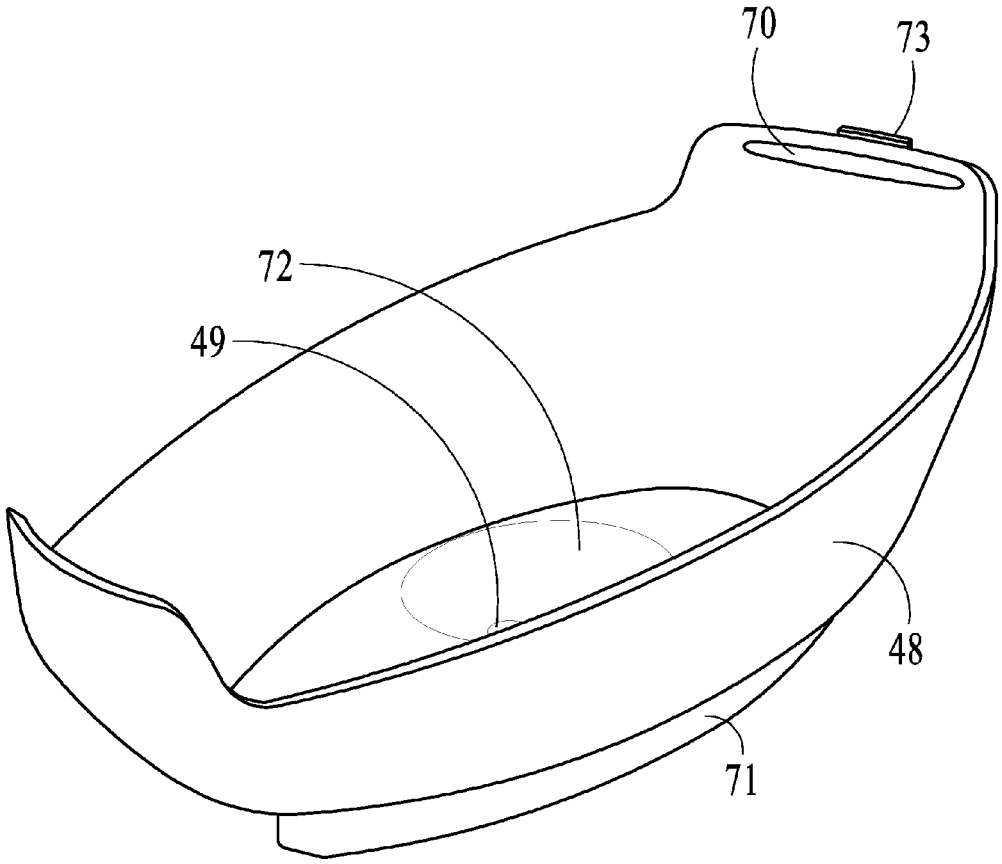
FIG. 9 shows a molded removable hard funnel that fits and molds exactly around a bottle base in accordance with an implementation.

FIG. 9 shows a molded removable hard funnel that fits and molds exactly around the bottle base. Each bottle can be three dimensionally scanned to exactly match the contours of any spray bottle or standard non spray bottle. The molded funnel has a fixed or extending nozzle and opening to allow delivery of fluid flowing in accordance with an implementation. The funnel can connect to the refill valve to allow the injection of the concentrate solution or powder and water via the funnel to the refill valve from any faucet. Specifically, FIG. 9 shows a three-dimensionally scanned molded attachable funnel 48 with telescoping extending nozzle 49 and opening 72. Funnel 48 can be detached from the base or bottom of the bottle 45 and attached to the refill valve opening when screw cap 1 or flip top cap 2 is removed. The funnel 48 is held in place and connected to the bottom of bottle 45 by compression or clip 70 that attach to the bottle 45 into female receptacle 101. The funnel 48 sits on two plastic rails 71 which increase the height of funnel 48 so that the length of nozzle 49 can be increased or lengthened so it's long enough to dock into receptacle 8 inside the refill valve. Opening 72 creates a Venturi effect as the water or refill fluid is dispensed through the refill valve via refill line 60. Handle or clip with a grip 73 is used to quickly detach the molded funnel 48 from the bottle 45 when needed. The bottle 45 is simply snapped into place into funnel 48 when the refill process is complete so that the funnel is never lost and stays with the bottle 45 ready for the next refill.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A spray bottle system, comprising;

a spray bottle that holds liquid, the spray bottle having a threaded top;

a tube that extends to a bottom of the spray bottle;

a spray head attached to the tube, the spray head including:

a threaded female fitting that attaches to the threaded top of the spray bottle, the threaded female, when screwed on to the threaded top of the spray bottle, securely attaching the spray head to the spray bottle, a spray mechanism connected to the tube, the spray mechanism drawing fluid from the bottom of the spray bottle, through the tube, to produce a spray of the fluid, a refill valve, the refill valve, when opened, providing a conduit to refill the spray bottle so that fluid can be poured into the spray bottle without unscrewing the threaded fitting and removing the spray head from the spray bottle, and a refill valve cap that when in a shut position, closes the refill valve to prevent spilling of the liquid when the spray bottle is not being refilled.

2. A spray bottle system as in claim 1, wherein the refill valve cap includes a hinge that keeps refill valve cap attached to the spray head when the refill valve is in an open position.

3. A spray bottle system as in claim 1, wherein the spray head additionally comprises:

a vent line that vents the spray bottle when the spray bottle is being filled with the fluid through the refill valve, the vent line allowing air to escape from the spray bottle as the fluid is being added to the spray bottle through the refill valve.

4. A spray bottle system as in claim 1, wherein the spray head additionally comprises:

a receptacle for an applicator;

a dispensing valve;

a cross slit valve, the dispensing valve and the cross slit valve being situated between the receptacle and the refill valve so that the applicator can be pushed into the refill valve, through the dispensing valve and through the cross slit valve to be received by the receptacle;

wherein the dispensing valve and the cross slit valve are zero opening pressure valves which allow the flow of air and fluid in one direction but will close when fluid or air pressure inside the spray bottle closes the dispensing valve and the cross slit valve.

5. A spray bottle system as in claim 1, additionally comprising:

a funnel sized so that a narrow bottom part of the funnel fits within the refill valve.

6. A spray bottle system as in claim 1, additionally comprising:

a funnel sized so that a narrow bottom part of the funnel fits within the refill valve and so that a wider top shape conforms to an outside shape of a bottom of the spray bottle, allowing the funnel to be secured as a sleeve on the bottom of the spray bottle.

7. A spray bottle system as in claim 1, additionally comprising:

a funnel sized so that a narrow bottom part of the funnel fits within the refill valve and so that a wider top shape conforms to an outside shape of a bottom of the spray bottle, allowing the funnel to be secured as a sleeve on the bottom of the spray bottle, the funnel including a compression fitting for securing the funnel to the spray bottle.

8. A spray bottle system as in claim 1, additionally comprising:

a funnel sized so that a narrow bottom part of the funnel fits within the refill valve and so that a wider top shape conforms to an outside shape of a bottom of the spray bottle, allowing the funnel to be secured as a sleeve on the bottom of the spray bottle, the funnel including a clip for securing the funnel to the spray bottle.

9. A spray head for a spray bottle, comprising:

a spray mechanism connected to a tube that extends into the spray bottle, the spray mechanism drawing fluid from a bottom of the spray bottle, through the tube, to produce a spray of the fluid;

a threaded female fitting that attaches to a threaded top of the spray bottle, the threaded female, when screwed on to the threaded top of the spray bottle, securely attaching the spray head to the spray bottle;

a refill valve, the refill valve, when opened, providing a conduit to refill the spray bottle so that fluid can be poured into the spray bottle without unscrewing the threaded fitting and removing the spray head from the spray bottle; and, a refill valve cap that when in a shut position, closes the refill valve to prevent spilling of the liquid when the spray bottle is not being refilled.

10. A spray head as in claim 9, wherein the refill valve cap includes a hinge that keeps refill valve cap attached to the spray head when the refill valve is in an open position.

11. A spray head as in claim 9, additionally comprising:

a modified spray head seal that includes cut outs, the cut outs allowing the fluid to pass through the spray head into the spray bottle.

12. A spray head as in claim 9, additionally comprising:

a receptacle for an applicator; and, a cross slit valve, the dispensing valve and the cross slit valve being situated between the receptacle and the refill valve so that the applicator can be pushed into the refill valve, through the dispensing valve and through the cross slit valve to be received by the receptacle;

wherein the dispensing valve and the cross slit valve are zero opening pressure valves which allow the flow of air and fluid in one direction but will close when fluid or air pressure inside the spray bottle closes the dispensing valve and the cross slit valve.

13. A method to operate and refill a spray bottle system, the method comprising;

storing liquid in a spray bottle;

attaching a spray head attached to a tube that extends to liquid stored in the spray bottle;

using a threaded female fitting of the spray head to securely attach the spray head to a threaded top of the spray bottle by screwing the threaded female fitting to a threaded top of the spray bottle;

providing a spray mechanism of the spray head to draw fluid from the bottom of the spray bottle, through the tube, to produce a spray of the fluid;

providing a refill valve on the spray head, the refill valve, when opened, providing a conduit to refill the spray bottle so that fluid can be poured into the spray bottle without unscrewing the threaded fitting and removing the spray head from the spray bottle; and, providing a cap on the refill valve to allow the refill valve to be shut when the spray bottle is not being refilled.

14. A method as in claim 13, additionally comprising:

modifying seals on the spray head to provide cut outs which provide a path for the fluid to pass through the spray head to the spray bottle.

15. A method as in claim 13, additionally comprising:

providing a vent line within the spray head so that the vent line vents the spray bottle when the spray bottle is being filled with the fluid through the refill valve, the vent line allowing air to escape from the spray bottle as the fluid is being added to the spray bottle through the refill valve.

16. A method as in claim 13, additionally comprising:

using an applicator to place the fluid through the refill valve, including:

pushing the applicator into the refill valve, through a cross slit valve and a dispensing valve in order to be received by a receptacle within the spray head;

wherein the dispensing valve and the cross slit valve are zero opening pressure valves which allow the flow of air and fluid in one direction but will close when fluid or air pressure inside the spray bottle closes the dispensing valve and the cross slit valve.

17. A method as in claim 13, additionally comprising:

using a funnel sized so that a narrow bottom part of the funnel fits within the refill valve in order to add the fluid though the refill valve into the spray bottle.

18. A method as in claim 13, additionally comprising:

using a funnel sized so that a narrow bottom part of the funnel fits within the refill valve in order to add the fluid though the refill valve into the spray bottle wherein a a wider top shape of the funnel conforms to an outside shape of a bottom of the spray bottle, allowing the funnel to be secured as a sleeve on the bottom of the spray bottle.

19. A method as in claim 13, additionally comprising:

using a funnel sized so that a narrow bottom part of the funnel fits within the refill valve in order to add the fluid though the refill valve into the spray bottle wherein a a wider top shape of the funnel conforms to an outside shape of a bottom of the spray bottle, allowing the funnel to be secured as a sleeve on the bottom of the spray bottle, including:

using a compression fitting for securing the funnel to the spray bottle.

20. A method as in claim 13, additionally comprising:

using a funnel sized so that a narrow bottom part of the funnel fits within the refill valve in order to add the fluid though the refill valve into the spray bottle wherein a a wider top shape of the funnel conforms to an outside shape of a bottom of the spray bottle, allowing the funnel to be secured as a sleeve on the bottom of the spray bottle, including:

using a clip for securing the funnel to the spray bottle.

* * * * *